US007363661B1

(12) United States Patent
Myers

(10) Patent No.: US 7,363,661 B1
(45) Date of Patent: Apr. 29, 2008

(54) PORTABLE URINAL

(76) Inventor: Stanley Alan Myers, 124 Elk Ridge Dr., Longview, WA (US) 98632

( * ) Notice: Subject to any disclaimer, the term of this patent is extended or adjusted under 35 U.S.C. 154(b) by 322 days.

(21) Appl. No.: 11/169,132

(22) Filed: Jun. 27, 2005

(51) Int. Cl.
*A47K 11/00* (2006.01)

(52) U.S. Cl. ..... 4/144.1; 4/455

(58) Field of Classification Search ..... 4/114.1, 4/144.1, 144.3, 283, 450–457, 462; D23/296
See application file for complete search history.

(56) References Cited

U.S. PATENT DOCUMENTS 1,160,553 A * 11/1915 Whalen ..... 4/283
1,869,036 A * 7/1932 Zink ..... 4/312
2,932,830 A * 4/1960 Lund ..... 4/450
3,349,768 A 10/1967 Keane
3,383,713 A 5/1968 Adams
5,848,443 A 12/1998 Waugh
5,852,830 A 12/1998 Horn
6,079,058 A 6/2000 Green
6,317,900 B1 11/2001 Braxton
6,389,609 B1 5/2002 Andritz
6,643,849 B2 11/2003 Sands
2004/0003457 A1 1/2004 Renda
2004/0064112 A1 4/2004 Sun

* cited by examiner

*Primary Examiner*—Charles E. Phillips
(74) *Attorney, Agent, or Firm*—Bullivant Houser Bailey PC

(57) ABSTRACT

A portable urinal comprises an upper pan and a lower pan, the pans being joined together to create a liquid receiving cavity. The upper pan has an upper surface which may be ovate shaped like a conventional toilet seat. A funnel in the approximate center of the upper pan empties through a small tube into the cavity. The side of the funnel to the front of the urinal is sloped more gently than the remaining sides of the funnel. The urinal has a relatively low profile, allowing it to be slipped easily between a user and a seat, such as in a car or in an airplane. After a user voids into the urinal, the small size of the tube helps prevent urine from escaping from the cavity. When the urinal is upside-down or on its side, for example, urine pools away from the funnel opening. A capable drain spout is provided for emptying the cavity of fluid when it is so desired.

11 Claims, 3 Drawing Sheets

PORTABLE URINAL

FIELD

The present application concerns a compact, portable urinal for use in an automobile, private airplane or other circumstance where a toilet is not conveniently available.

BACKGROUND

It is often necessary, especially when traveling, to urinate when no restroom facilities are available. Urinals for use in vehicles exist, but they are often difficult to use. Existing urinals may also be susceptible to spilling much of their contents if tilted or turned upside-down.

The problems described above are merely representative of problems that may be solved by the urinal described in this application, and other problems not discussed in interests of brevity may also be addressed by the described urinal.

SUMMARY

A portable urinal comprises an upper pan and a lower pan, the pans being joined together to create a cavity. The upper pan comprises a seat portion which may be ovate shaped like a conventional toilet seat, and a funnel portion in the approximate center of the upper pan and which empties into the cavity through a relatively small drain opening. The front end of the funnel is sloped more gently towards the drain opening than the remaining portion of the funnel. The urinal has a relatively low profile, allowing it to be slipped easily between a user and a seat in an automobile or in an airplane, for example. After a user voids into the urinal, the small opening in the lower end of the funnel helps prevent urine from spilling from the urinal as it is subsequently handled. When the urinal is moved and placed upside-down or on a side, for example, urine pools away from the funnel opening. The urinal may be emptied through a drain hole and cleaned, after which the urinal may be reused. The urinal may be constructed of a number of materials, but is preferably constructed of blow-molded plastic.

The foregoing and other objects, features, and advantages of the invention will become more apparent from the following detailed description, which proceeds with reference to the accompanying drawings which illustrate a preferred embodiment of the invention.

DETAILED DESCRIPTION

Disclosed below is a representative apparatus. The illustrated embodiment should not be construed as limiting in any way. Instead, the present disclosure is directed toward novel and non-obvious features and aspects of the disclosed embodiments.

Figure 1:
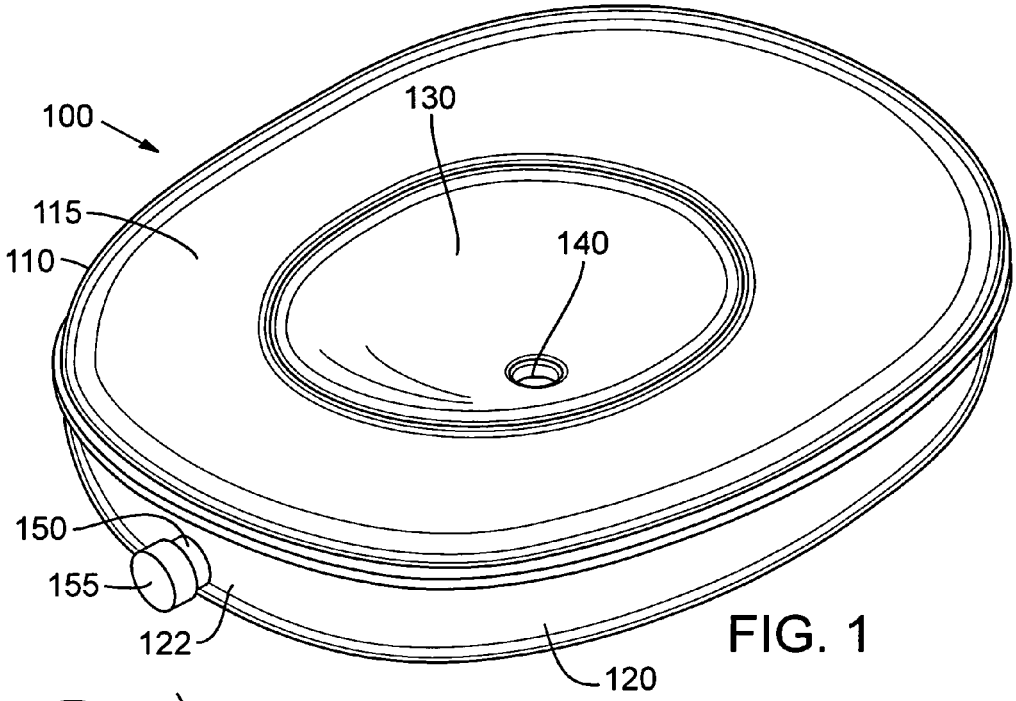
FIG. 1 is a perspective view of a portable urinal constructed in accordance with the invention.

Referring first to FIG. 1, the urinal 100 is comprised of an upper pan 110 and a lower pan 120, which are preferably formed as a single unit as by blow molding a suitable plastic. Alternatively, the pans 110 and 120 may be fabricated separately from plastic, metal, or any other suitable material, including rigid and semi-rigid materials, and joined together. One pan may be fabricated from a first material, and the other pan from a second material.

The uppermost surface portion 115 of the upper pan 110 may be generally, and is preferably, ovate in shape comfortably to accommodate a seated person and may resemble a traditional toilet seat in conformation having greater length than width. The surface 115 slopes gently downwardly from the outer edge of the pan 110 towards the center and defines a seat which may be provided with a cushion (not shown). The center portion of the upper pan 110 is formed as a funnel 130 which slopes downwardly from the seat portion 115 to a drainage tube 140 extending into the cavity 142 created by the upper pan 110 and the lower pan 120. The tube 140 is preferably positioned substantially equidistantly from the opposite sides and from the opposite ends of the urinal body. The urinal 100 is provided with a drain 150 (shown with a water-tight removable cap 155) preferably located in a side wall 122 of the lower pan 120 for emptying the contents of and cleaning the urinal 100. In a preferred embodiment, the urinal 100 is ovate in shape and is approximately 16 inches long by 14 inches wide by 4 inches deep, with the funnel 130 being approximately 6 to 7 inches across its top and the drainage tube 140 being about 0.5 inches in diameter. The funnel 140 preferably terminates a short distance, that is, approximately one inch above the bottom wall 124 of the lower pan 120. The relatively low profile of the urinal allows for its relatively convenient use on car seats, camping chairs, airplane seats, etc. The elongated shape of the opening defined by the seat 115 aids in accommodating the forward positions of the female urethra and the male penis. The drain 150 may be approximately 1 to 1.5 inches in diameter.

Figure 5:
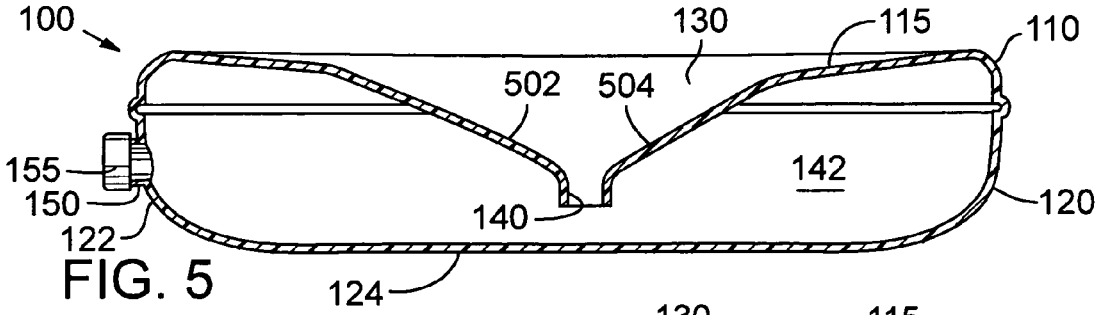
FIG. 5 is an enlarged cross-sectional view along line 5-5 in FIG. 3.
Figure 6:
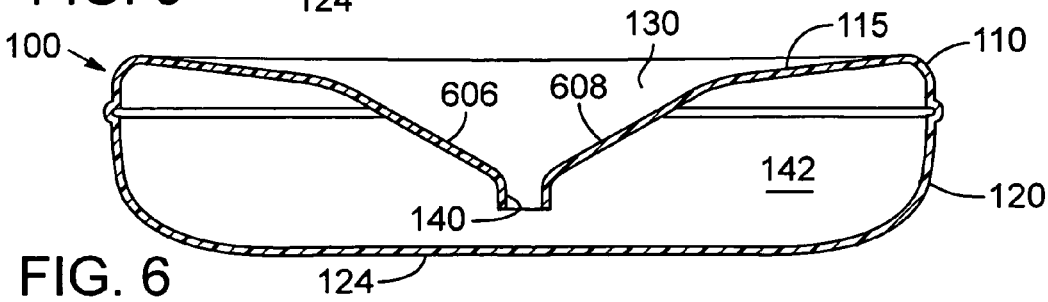
FIG. 6 is an enlarged cross-sectional view along line 6-6 in FIG. 3.

As seen in FIGS. 5 and 6, the wall portions of the funnel 130 have differing slopes. In the preferred embodiment, the front portion 502 has a more gradual slope than the rear portion 504 or side portions 606 and 608. As the seats on many automobiles and airplanes are tilted such that the front of the seat is higher than the back of the seat, the steeper slope on the rear portion 504 provides a better angle of drainage for the rear portion of the funnel 130.

Figure 7:
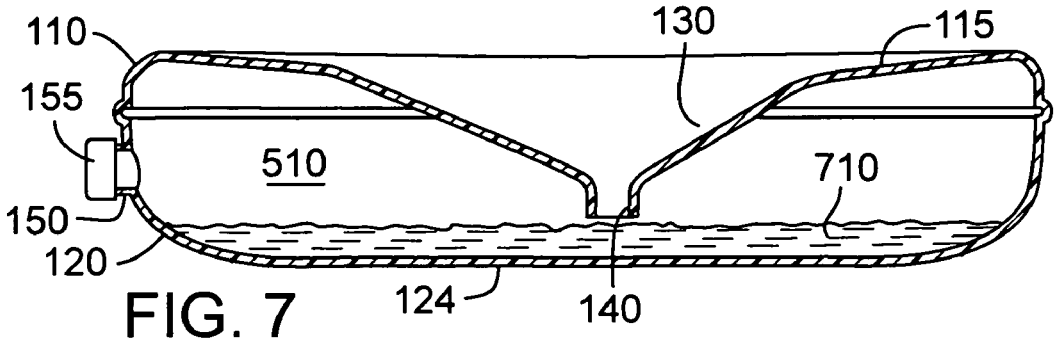
FIG. 7 is a cross-sectional view of the portable urinal of FIG. 1 containing fluid and in an upright position.
Figure 8:
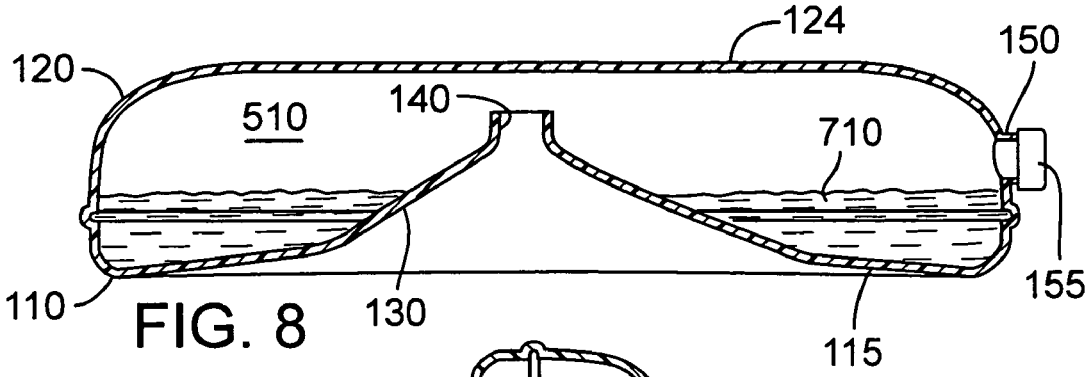
FIG. 8 is a cross-sectional view of the portable urinal of FIG. 1 containing fluid and in an upside-down position.
Figure 9:
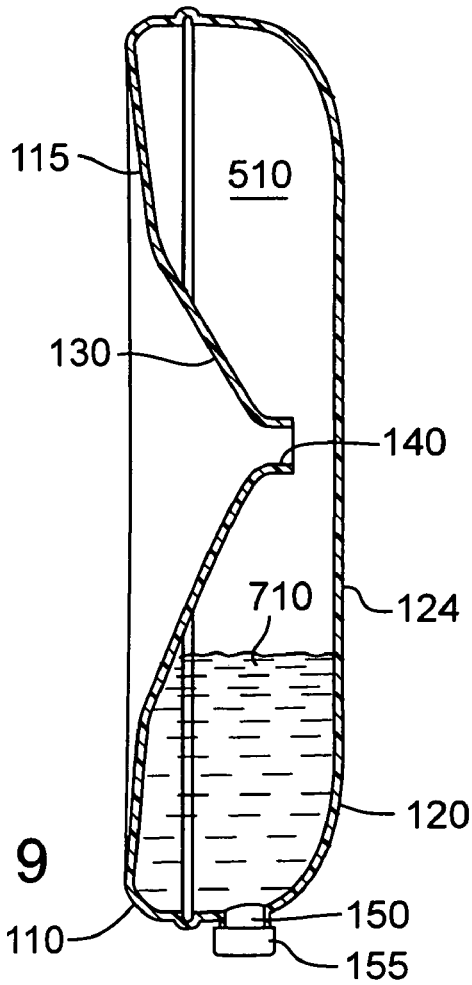
FIG. 9 is a cross-sectional view of the portable urinal of FIG. 1 containing fluid and in an on-end position for emptying it of fluid.

FIGS. 7, 8 and 9 illustrate the ability of the portable urinal 100 to retain its contents when turned upside-down or on its side. The converging walls of the funnel 130 and the relatively small diameter of the drainage tube 140 help prevent any fluid 710 from spilling out of tube 140. Instead, the fluid 710 pools away from the tube 140, as shown in FIGS. 8 and 9.

Figure 2:
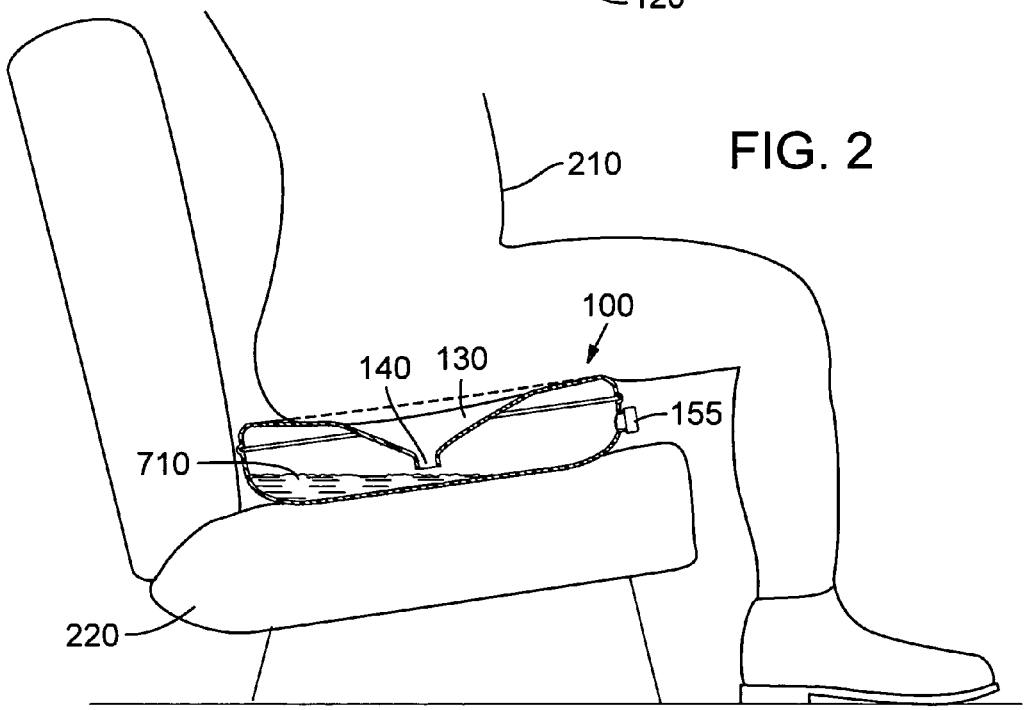
FIG. 2 is a depiction of how the portable urinal of FIG. 1 may be used on a seat (e.g., in an automobile or an airplane).
Figure 3:
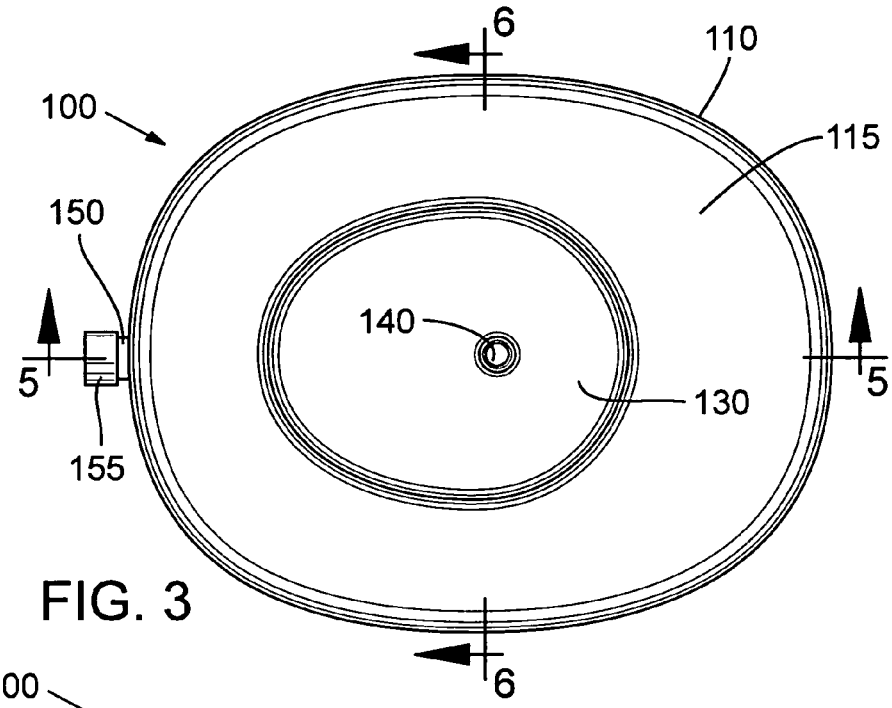
FIG. 3 is a top view of the urinal of FIG. 1.
Figure 4:
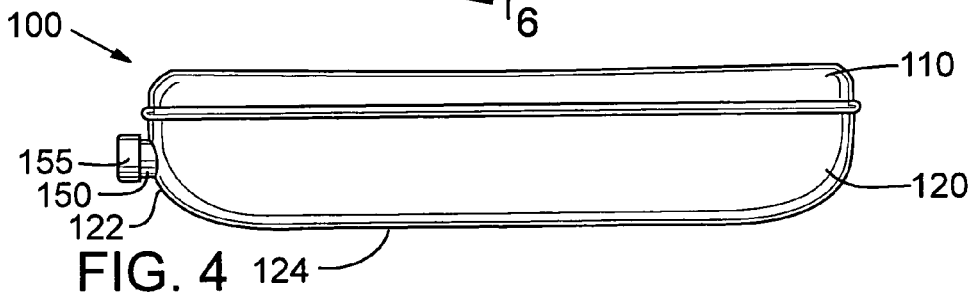
FIG. 4 is a side view of the portable urinal of FIG. 1.

Some aspects of using the urinal 100 are shown in FIG. 2. A user 210 removes some clothing as if he/she intended to use a conventional toilet. Urinal 100 is then slipped between the user 210 and the seat 220. With the user 210 sitting on surface 115, the user voids into the funnel 130, and urine drains into the cavity 142 through the funnel tube 140. The urinal 100 is then slipped from under the user and placed it in any position on the floor or under the seat, for example. The risk of urine spilling back through the funnel tube 140 is generally very low while the level of urine remains below the level of the bottom of the tube 140 in the upright position of the urinal. A urinal 100 of approximately 16 in.×14 in.×4 in. can hold approximately two liters of fluid before reaching this level. At a later convenient time and place, the urinal 100 may be drained and cleaned.

In view of the many possible embodiments to which the principles of the disclosed invention may be applied, it should be recognized that the illustrated and described embodiment is only a preferred example of the invention and should not be taken as limiting the scope of the invention. Rather, the scope of the invention is defined by the following claims. I therefore claim as my invention all that comes within the scope and spirit of these claims.

I claim:

1. A portable urinal, comprising:

a bottom section having a bottom wall and a first sidewall portion extending upwardly from said bottom wall; and a top section having a top surface defining a downwardly sloping funnel portion a seat portion surrounding said funnel portion and a downwardly extending second sidewall portion joined to the said first sidewall portion to provide a urine receiving cavity between said top and bottom sections, said funnel portion having an opening into said cavity, wherein said opening is centered substantially equidistantly from the opposite ends of said urinal and from the opposite sides thereof wherein said funnel portion is eccentric in cross section and less steeply downwardly sloped in the portion thereof sloping from said front end of said seating surface than from the sides and rear end of said seating surface.

2. The urinal of claim 1, wherein said seat portion defines an ovate seating surface having greater length than width and a front and a rear end.

3. The urinal of claim 1 wherein said opening is centered substantially equidistantly from the opposite ends of said urinal and from the opposite sides thereof.

4. The urinal of claim 1 wherein said funnel portion terminates a short distance above said bottom wall.

5. The urinal of claim 1, including a drain spout positioned on said first sidewall portion for draining said cavity.

6. The urinal of claim 5, including a removable cap mounted on said drain spout.

7. A portable urinal, comprising:

a bottom section having a bottom wall and a first sidewall portion extending upwardly from said bottom wall; and a top section having a top surface defining a downwardly sloping funnel portion terminating a short distance above said bottom wall, a seat portion surrounding said funnel portion and a downwardly extending second sidewall portion joined to the said first sidewall portion to provide a urine receiving cavity between said top and bottom sections, said funnel portion having an opening into said cavity wherein said opening is centered substantially equidistantly from the opposite ends of said urinal and from the opposite sides thereof, wherein said funnel portion is eccentric in cross section and less steeply downwardly sloped in the portion thereof sloping from said front end of said seating surface than from the sides and rear end of said seating surface.

8. The urinal of claim 7, wherein said seat portion defines an ovate seating surface having greater length than width and a front and a rear end.

9. The urinal of claim 7 wherein said opening is centered substantially equidistantly from the opposite ends of said urinal and from the opposite sides thereof.

10. The urinal of claim 7, including a drain spout positioned on said first sidewall portion for draining said cavity.

11. The urinal of claim 10, including a removable cap mounted on said drain spout.

* * * * *